US006896509B2

(12) United States Patent
Carroni et al.

(10) Patent No.: US 6,896,509 B2
(45) Date of Patent: May 24, 2005

(54) COMBUSTION METHOD AND BURNER FOR CARRYING OUT THE METHOD

(75) Inventors: Richard Carroni, Niederrohrdorf (CH); Peter Flohr, Birmenstorf (CH)

(73) Assignee: ALSTOM Technology LTD, Baden (CH)

( * ) Notice: Subject to any disclaimer, the term of this patent is extended or adjusted under 35 U.S.C. 154(b) by 0 days.

(21) Appl. No.: 10/756,325

(22) Filed: Jan. 14, 2004

(65) Prior Publication Data

US 2004/0146820 A1 Jul. 29, 2004

(30) Foreign Application Priority Data

Jan. 14, 2003 (CH) ..... 2003 0046/03

(51) Int. Cl.[7] ..... F23D 14/22
(52) U.S. Cl. ..... 431/9; 431/170
(58) Field of Search ..... 431/8, 9, 10, 11, 431/170; 60/775, 778

(56) References Cited

U.S. PATENT DOCUMENTS

| | | | | | |
|---|---|---|---|---|---|
| 3,729,285 | A | * | 4/1973 | Schwedersky | 431/8 |
| 3,868,211 | A | * | 2/1975 | Haye et al. | 431/10 |
| 3,914,090 | A | * | 10/1975 | Pfefferle | 431/9 |
| 4,731,989 | A | * | 3/1988 | Furuya et al. | 60/775 |
| 5,277,578 | A | * | 1/1994 | Ratnani et al. | 431/351 |
| 5,433,596 | A | | 7/1995 | Döbbeling et al. | 431/350 |
| 5,518,697 | A | | 5/1996 | Dalla Betta et al. | 422/173 |
| 5,577,378 | A | | 11/1996 | Althaus et al. | 60/39.17 |
| 5,588,826 | A | | 12/1996 | Döbbeling et al. | 431/354 |
| 5,626,017 | A | | 5/1997 | Sattelmayer | 60/723 |
| 6,302,683 | B1 | * | 10/2001 | Vestin et al. | 431/7 |
| 6,339,925 | B1 | | 1/2002 | Hung et al. | 60/39.06 |
| 6,652,265 | B2 | * | 11/2003 | Cain | 431/6 |

FOREIGN PATENT DOCUMENTS

| | | |
|---|---|---|
| DE | 42 02 018 C1 | 4/1993 |
| EP | 1 255 077 A2 | 11/2002 |
| EP | 1 255 077 A3 | 1/2004 |
| WO | 02/068867 A3 | 9/2002 |
| WO | 02/068867 A2 | 9/2002 |

OTHER PUBLICATIONS

Search Report from EP 03104559.4 (May 13, 2004).
Search Report from CH 462003 (Apr. 17, 2003).

* cited by examiner

*Primary Examiner*—Stephen Gravini
(74) *Attorney, Agent, or Firm*—Cermak & Kenealy, LLP; Adam J. Cermak

(57) ABSTRACT

In a combustion method, in a burner (12, 20), a fuel/air mixture flowing through a flow passage (13) is made to react in a first combustion stage in a catalytic reactor (15), and downstream of the catalytic reactor (15) fuel is burnt together with the exhaust gas from the catalytic reactor (15) in a second combustion stage to form a homogenous flame (17) by self-ignition.

If the fuel from the fuel/air mixture is only partially burnt in the first combustion stage in the catalytic reactor (15), and the unburnt remainder of the fuel is burnt in the second combustion stage, combustion can be stabilized by virtue of the fact that the fuel-containing exhaust gas from the catalytic reactor (15), between the outlet of the catalytic reactor (15) and the homogenous flame (17) is passed through devices 916, 19) which aerodynamically stabilize the homogenous flame (17).

12 Claims, 1 Drawing Sheet

COMBUSTION METHOD AND BURNER FOR CARRYING OUT THE METHOD

BACKGROUND OF THE INVENTION

1. Field of the Invention

The present invention deals with the field of combustion technology. It relates to a combustion method in accordance with the preamble of claim 1 and to a burner for carrying out the method.

2. Discussion of Background

Catalytic combustion is a method which can be used in gas turbines to increase the stability of the combustion process and to reduce the levels of emission (cf. for example U.S. Pat. No. 6,339,925 B1). Limits on the load which can be applied to materials and on the operating conditions require the catalytic reactors used to convert only part (typically up to 60%) of the total amount of fuel flowing through the burner. Therefore, the gas temperature which results may not be sufficiently increased to thermally stabilize the combustion of the fuel which remains at the outlet of the catalytic reactor (and comprises a homogenous mixture of fuel, $O_2$, $N_2$, CO, $CO_2$, and $H_2O$ at temperatures between 600° C. and 950° C.). Consequently, aerodynamic stabilization is required.

One simple solution involves using sudden expansion downstream of the catalytic reactor, with recirculation zones at the ends of the widening bringing about anchoring (cf. for example U.S. Pat. No. 5,626,017). However, this technique only works at relatively high temperatures at the catalytic reactor outlet. However, if greater dynamic stabilization is required, this can be achieved by the formation of highly swirled flows which promote vortex breakdown. U.S. Pat. No. 5,433,596 describes a double-cone burner in accordance with the prior art which brings about such vortex breakdown. A number of other configurations, for example as described in U.S. Pat. No. 5,588,826, likewise achieve this objective. However, a large-volume vortex of this nature requires relatively complex devices which cause considerable pressure drops.

A simplified vortex generator, which is also known as a SEV vortex generator and is distinguished by reduced pressure losses, has been disclosed by U.S. Pat. No. 5,577,378. It has proven suitable for sequential combustion or combustion with afterburning. The action of the device is based on an exhaust-gas temperature at the outlet of the first burner which is above the self-ignition temperature of the fuel injected in the second burner; the combustion chamber for the afterburning is a burner-free space with a number of vortex generators, the purpose of which is to mix the fuel of the second stage with the exhaust gas from the first stage prior to self-ignition. The degree of circulation and the form of the axial velocity profile can be tailored to the specific requirements by suitable selection of the geometric parameters of the vortex generator (length, height, leading angle) and in extreme cases can even lead to a free-standing vortex breakdown, as is sometimes observed in aircraft with delta wings at large leading angles.

The abovementioned U.S. Pat. No. 5,626,017 has described a combustion chamber for a gas turbine with two-stage sequential combustion in which, in the first stage, the fuel/air mixture produced in a mixer is completely burnt in a catalytic reactor. The exhaust gas which emerges from the catalytic reactor is at a relatively high temperature of 800° C. to 1100° C. Vortex generators, as shown for example in FIG. 1 of the present application, are arranged downstream of the outlet of the catalytic reactor. The vortex generators generate a turbulent flow into which fuel is then injected downstream. The exhaust/fuel mixture which forms then self-ignites and forms a flame front which is aerodynamically stabilized by means of a step-like cross-sectional widening in the flow passage. In this case, the vortex generators have the exclusive function of promoting the mixing of exhaust gas and injected fuel. By contrast, the stabilization of the flame front is effected by the widening of the cross section.

The situation is different in the case of a two-stage burner configuration in which the fuel/air mixture is not completely burnt in the first stage, but rather the exhaust gas from the catalytic reactor contains a proportion of unburnt fuel and at the same time has a significantly reduced outlet temperature (e.g. 600° C. to 950° C.). Since in this case no additional fuel has to be injected in the second stage and accordingly also does not have to be mixed with the exhaust gas from the catalytic reactor, in this case the situation is different in terms of flow technology and in particular with regard to the stabilization of the flame front.

SUMMARY OF THE INVENTION

Accordingly, one object of the invention is to provide a novel two-stage combustion method with catalytic reactor in the first combustion stage, which is simple and reliable to carry out and leads to lower pressure losses, and to provide a burner for carrying out the method.

The object is achieved by the combination of features of claims 1 and 7. The essence of the invention consists in aerodynamically stabilizing the homogenous flame produced in the second stage of combustion in which unburnt fuel from the first combustion stage, which is equipped with a catalytic reactor, is afterburnt in said second combustion stage, by the fuel-containing exhaust gas from the catalytic reactor, between the outlet of the catalytic reactor and the homogenous flame, being passed through devices which aerodynamically stabilize the homogenous flame.

According to a preferred configuration of the invention, the aerodynamically stabilizing devices used are vortex generators which are arranged at the outlet of the catalytic reactor.

According to a preferred refinement of this configuration, an additional aerodynamically stabilizing device used is a step-like widening in the flow passage, which is arranged between the vortex generators and the homogenous flame.

In particular at the outlet from the catalytic reactor, the exhaust gas contains $O_2$, $N_2$, CO, $CO_2$ and $H_2O$ in addition to the unburnt fuel, emerges from the catalytic reactor at a flow velocity of less than or equal to 50 m m/s and is then at a temperature of between 600° C. and 950° C.

Furthermore, it is conceivable for fuel which is guided past the outside of the catalytic reactor, in a bypass, to be added to the exhaust gas downstream of the catalytic reactor.

Finally, it is conceivable for $H_2$/CO from a fuel-rich catalytic pilot burner to be present in the medium flowing through the flow passage.

A preferred configuration of the burner according to the invention is characterized in that a step-like widening of the flow passage is additionally provided downstream of the vortex generators.

Furthermore, it is advantageous if the formation of the vortex generators is dependent on whether the vortex generators are intended primarily for mixing or for vortex breakdown.

BRIEF DESCRIPTION OF THE DRAWINGS

A more complete appreciation of the invention and many of the attendant advantages thereof will be readily obtained as the same becomes better understood by reference to the following detail description when considered in connection with the accompanying drawings, wherein.

DESCRIPTION OF THE PREFERRED EMBODIMENTS

Figure 1:
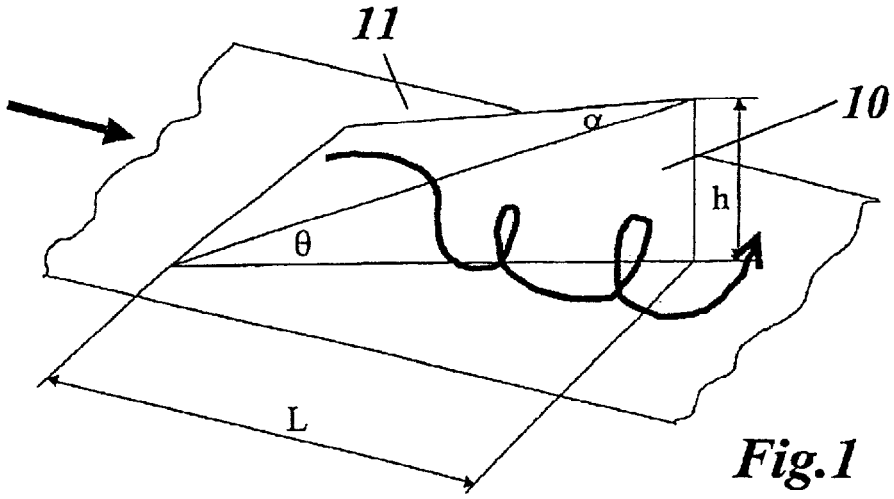
FIG. 1 shows a perspective illustration of a vortex generator which can be used for the solution according to the invention, as already known from the prior art in SEV burners (cf. U.S. Pat. No. 5,577,378)

Referring now to the drawings, wherein light reference numerals designate identical or corresponding parts throughout the several views, it is proposed for what are known as SEV vortex generators to be used to aerodynamically stabilize the homogenous flames in particular with respect to the catalytic burner. The result of this method is that:

- sufficient flame stabilization is achieved irrespective of the outlet temperature at the catalytic reactor, so that operation is possible even if the outlet temperature at the catalytic reactor is low;
- the pressure drop is minimized; and
- flow and temperature fields are made more uniform toward the turbine inlet and profit from the increased mixing of the vortex flows.

Furthermore, the use of SEV vortex generators is advantageous because there is already extensive experience available relating to the design of these elements (in terms of cooling, fatigue, flame position, pulsation, velocity and temperature distribution) from high-temperature burners with afterburning, and this experience can be directly applied to burners with catalytic elements.

The wedge-shaped or tetrahedral SEV vortex generators 10 which is illustrated in FIG. 1, bears against a combustion chamber wall 11 and has been described in U.S. Pat. No. 5,577,378 is particularly suitable for use in the present solution. The degree of circulation and the configuration of the axial velocity profile can be set as desired by suitably choosing the parameters (length L, height H, leading angle $\alpha$ and the angle $\theta$ derived from these three variables). Depending on the precise requirements, these parameters can be set in such a way that only mixing (lowest pressure drop) or mixing and vortex breakdown (higher pressure loss on account of the formation of a recirculation zone downstream) results. In any event, a pair of oppositely rotating flow vortices is generated.

Figure 2:
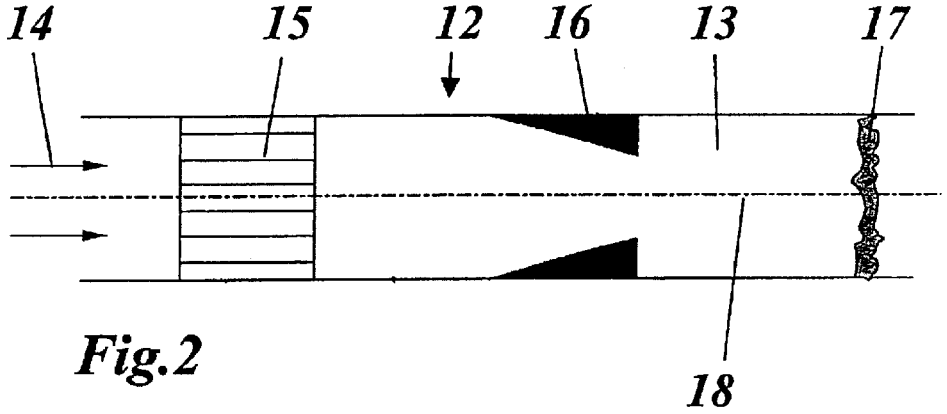
FIG. 2 shows a diagrammatic longitudinal section through a burner in accordance with a first preferred exemplary embodiment of the invention.

FIG. 2 shows a configuration of a burner 12 with a flow passage 13 extending along an axis 18. A catalytic reactor 15 is arranged in the flow passage 13. The flow 14 of a fuel/air mixture enters the catalytic reactor 15 from the left. The fuel is partially burnt in the catalytic reactor 15. Then, an exhaust-gas stream, which, by way of example, contains $O_2$, $N_2$, CO, $CO_2$ and $H_2O$ in addition to the unburnt fuel, emerges at the outlet from the catalytic reactor 15. The composition of the exhaust gas is very uniform on account of the excellent mixing. The temperatures of the exhaust gas vary between 600° C. and 950° C. The flow velocity is typically less than or equal to 50 m/s. Vortex generators 16 of the form shown in FIG. 1 are arranged downstream of the catalytic reactor 15. The vortex generators 16 are designed in such a way that sufficient aerodynamic stabilization for a homogenous flame 17 to be stably localized in the position shown in FIG. 2 results. The precise design of the vortex generators 16 depends on the operator properties of the catalytic reactor 15:

- minimal circulation is required in the case of a catalytic reactor which generates exhaust gases at the highest temperatures (approximately 900–950° C.).
- maximum circulation and vortex breakdown is required if the outlet temperature at the catalytic reactor is at its lowest (approximately 600° C.).
- if the composition of the catalytic reactor exhaust gas lacks uniformity, the vortex generators serve to achieve a high degree of preliminary mixing prior to self-ignition
- the catalytic reactor may be designed in such a way that it produces a certain quantity of syngas ($H_2$ and CO). The higher reactivity of these gases reduces the level of aerodynamic stabilization required. More generally, the fuel content in the exhaust gas from the catalytic reactor determines the precise requirement and the aerodynamic stabilization.

In cases in which maximum aerodynamic stabilization is desirable, the vortex generators can be designed in such a way that the homogenous flames are prevented from attaching themselves to the elements.

In combination with a lean-burn standard premix burner, the gas stream flowing past the SEV vortex generators typically has a mean velocity of up to 150 m/s. Despite the very low pressure loss coefficient $\xi$ with a configuration of this nature, the high velocities result in high pressure losses (up to 4%). Burners with catalytic elements are generally characterized by significantly lower outlet velocities of approximately 50 m/s. The associated pressure loss is less than 2% and therefore constitutes a crucial reduction.

Although the gas mixture which emerges from the catalytic reactor has been very successfully mixed, there are types of burner in which fuel and/or air bypass the main catalytic reactor and are admixed downstream. The catalytic reactor may also include a pilot burner which generates its own combustion products (e.g. an enriched fuel/air mixture or syngas) which are then added to the main gas stream as well. This is an important consideration since the combustion of inhomogeneous mixtures leads to high local temperatures and thereby increases emissions. By their very nature, the vortex generators are also mixing devices and therefore ensure that the gas mixtures are intimately mixed prior to homogenous combustion.

If the vortex generators 16 are sufficiently steep, i.e. if the leading angle is large, they can cause recirculation zones to form downstream of them. The recirculation zones may be undesirable, since they could lead to the homogenous flame being anchored to the vortex generators. Such anchoring would cause considerable thermal loads at the devices and reduce the service life.

Figure 3:
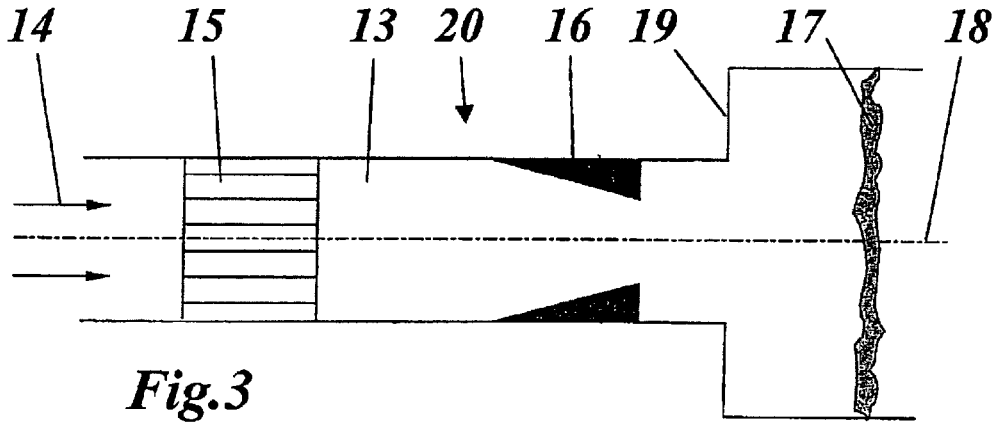
FIG. 3 shows an illustration similar to that presented in FIG. 2 of a second preferred exemplary embodiment of a burner according to the invention.

It is known that widening the cross section of the flow passage 13 promotes vortex breakdown. If a vortex generator is designed for relatively low circulation values, i.e. without a recirculation zone immediately downstream, subsequent expansion can cause the vortex to breakdown further downstream. This ensures that anchoring of the flame on or in the immediate vicinity of the vortex generator cannot occur. A corresponding configuration is illustrated in FIG. 3. The burner 20 shown in FIG. 3 differs from the burner 12 illustrated in FIG. 2 primarily through the fact that a step-like widening 19 in the cross section of the flow passage 13 is provided between the vortex generators 16 and the homogenous flame 17. This step-like widening 19 reliably prevents the flame 17 from becoming anchored to the elements 16, thereby putting the latter at risk.

Obviously, numerous modifications and variations of the present invention are possible in light of the above teachings. It is therefore to be understood that within the scope of the appended claims, the invention may be practiced otherwise than as specifically described herein.

What is claimed is:

1. A combustion method, comprising:

reacting a fuel/air mixture flowing through a flow passage in a first combustion stage in a catalytic reactor;

burning fuel downstream of the catalytic reactor together with the exhaust gas from the catalytic reactor in a second combustion stage to form a homogenous flame by self-ignition;

wherein reacting comprises partially burning the fuel from the fuel/air mixture in the first combustion stage in the catalytic reactor, creating an unburnt remainder of the fuel;

wherein the unburnt remainder of the fuel is burned in the second combustion stage; and passing fuel-containing exhaust gas from the catalytic reactor, between the outlet of the catalytic reactor and the homogenous flame, through devices which aerodynamically stabilize the homogenous flame.

2. The method as claimed in claim 1, wherein the aerodynamically stabilizing devices comprise vortex generators arranged at the output of the catalytic reactor.

3. The method as claimed in claim 2, wherein the aerodynamically stabilizing devices comprise a step-like widening in the flow passage arranged between the vortex generators and the homogenous flame.

4. The method as claimed in claim 1, wherein the exhaust gas at the outlet of the catalytic reactor comprises $O_2$, $N_2$, CO, $CO_2$, $H_2O$, and unburnt fuel.

5. The method as claimed in claim 1, wherein exhaust gas emerges from the catalytic reactor at a flow velocity of less than or equal to 50 m/s.

6. The method as claimed in claim 1, wherein exhaust gas emerges from the catalytic reactor at a temperature of between 600° C. and 950° C.

7. The method as claimed in claim 1, further comprising:

guiding fuel past the outside of the catalytic reactor; and adding said guided fuel to the exhaust gas downstream of the catalytic reactor.

8. The method as claimed in claim 1, further comprising:

introducing $H_2$/CO from a fuel-rich catalytic pilot burner into the medium flowing through the flow passage.

9. A burner useful for carrying out a method as claimed in claim 1, the burner comprising:

a flow passage;

a catalytic reactor in the flow passage for catalyzing a fuel/air mixture when flowing through the flow passage; and means for aerodynamically stabilizing a homogenous flame which forms downstream of the catalytic reactor, the stabilizing means arranged downstream of the catalytic reactor, the stabilizing means comprising vortex generators.

10. The burner as claimed in claim 9, further comprising:

a step-widening of the flow passage downstream of the vortex generators.

11. The burner as claimed in claim 9, wherein the vortex generators are configured and arranged to primarily effect mixing.

12. The burner as claimed in claim 9, wherein the vortex generators are configured and arranged to primarily effect breakdown of vortices.

* * * * *